US005915868A

United States Patent [19]

Frazell

[11] Patent Number: 5,915,868

[45] Date of Patent: Jun. 29, 1999

[54] PORTABLE TOOTHBRUSH WITH DENTIFRICE

[76] Inventor: Dale M. Frazell, 2119 Pleasanton Ave., Boise, Id. 83702

[21] Appl. No.: 09/074,962

[22] Filed: May 7, 1998

[51] Int. Cl.[6] ..... A46B 11/02

[52] U.S. Cl. ..... 401/132; 401/184; 401/268; 401/269

[58] Field of Search ..... 401/132, 133, 401/134, 135, 268, 175, 184, 269

[56] References Cited

U.S. PATENT DOCUMENTS

| | | | |
|---|---|---|---|
| D. 266,633 | 10/1982 | Wink | D4/18 |
| 1,811,833 | 6/1931 | Simon . | |
| 1,975,852 | 10/1934 | Laub | 15/135 |
| 2,550,190 | 4/1951 | Greenberg | 15/135 |
| 2,640,488 | 6/1953 | Velodota | 132/84 |
| 2,917,057 | 12/1959 | Busseuil | 401/268 X |
| 3,353,898 | 11/1967 | Lamberti | 401/132 |
| 3,463,170 | 8/1969 | McCullough | 401/132 X |
| 4,588,089 | 5/1986 | Yanz, Jr. et al. | 206/581 |
| 4,768,531 | 9/1988 | Broussard | 132/84 C |
| 4,844,641 | 7/1989 | Grosfilley et al. | 401/176 |
| 5,026,191 | 6/1991 | Akly | 401/175 |
| 5,044,386 | 9/1991 | Nelson | 132/309 |
| 5,476,333 | 12/1995 | Matthews | 401/132 |
| 5,584,593 | 12/1996 | Lafortune | 401/184 |
| 5,599,126 | 2/1997 | Hough | 401/184 |

FOREIGN PATENT DOCUMENTS

| | | | |
|---|---|---|---|
| 142632 | 7/1951 | Australia | 401/175 |
| 2583625 | 6/1985 | France | 401/132 |
| 2696916 | 4/1994 | France | 401/132 |

*Primary Examiner*—Steven A. Bratlie

*Attorney, Agent, or Firm*—Ken J. Pedersen; Barbara S. Pedersen

[57] ABSTRACT

Embodiments of a disposable toothbrush are described, which have a self-contained dentifrice package which is kept unopened until the moment of desired use. The toothbrush has a soft, flexible plastic head for breaking the dentifrice package and sharp, hollow tubes or needles for distributing the dentifrice to the bristles. The toothbrush is ergonomically designed to fit hand and mouth with smooth, comfortable edges and outer surfaces and to prevent choking hazards by positively fastening parts. It is further designed to look generally like a fountain pen so it can be more comfortably carried and, thus, more available and useful.

4 Claims, 5 Drawing Sheets

PORTABLE TOOTHBRUSH WITH DENTIFRICE

BACKGROUND OF THE INVENTION

1. Field of the Invention

The present invention relates to a portable toothbrush. More specifically, the invention provides a system within a portable toothbrush for delivery of a self-contained supply of dentifrice.

2. Related Art

A variety of portable toothbrushes having self-contained supplies of toothpaste or other dentifrice is known in the related art. U.S. Pat. No. 3,353,898 issued to Lamberti (filed Aug. 6, 1965) describes a self-contained puncturable package of toothpaste adhered to the head of a toothbrush on the opposite side of the bristles. Yanz in U.S. Pat. No. 3,353,898 issued May, 1986, discloses a toothbrush having a severable packet of toothpaste which is compressed by pressure applied against a stiff, hinged receptacle lid and, thus, driven against solid spikes in the back of the brush; hence, puncturing the packet and driving its contents driven through holes in the head to the bristles. Grosfilley in U.S. Pat. No. 4,844,641 issued July, 1989, discloses a toothbrush having "a cavity filled with a dose of toothpaste and initially closed by a protective film" which film is torn by compression against a sharp ridge; further compression drives the toothpaste through ducts within the head and into the bristles. Matthews in U.S. Pat. No. 5,476,333 (issued Dec. 19, 1995) discloses a packet of sterilizing solution which is punctured within its receptacle in the back of the brush upon closure of a stiff, hinged compartment lid having solid sharp-pointed projections. There remains a need for an effective, efficient, and comfortable toothbrush which is economical to manufacture and procure and which is appealing to modem ideas of style and utility.

SUMMARY OF THE INVENTION

The present invention operates to provide a portable toothbrush with discrete packets of dentifrice which may or may not be refillable. The invention is improved over related art in its innovative mechanical design, in its ergonomic facility in both gripping the handle and moving the soft, rounded head through the mouth, and in its outward appearance.

Outwardly, the invention is designed to look like a fountain pen. It is approximately the length and diameter of a fountain pen to make it easier and more convenient to carry and, therefore, more available when wanted. To avoid possible user confusion, the handle and cover are made oblate rather than round as are most pens. The inventive toothbrush is designed to be ergonomically appealing with large-diameter handle for improved grip and rounded, curved neck for comfort against hand and mouth. Further, the head behind the bristles is constructed of flex-memory plastic so that, in addition to its toothpaste-delivery function, it presents a soft and round surface within the mouth. This is a distinct improvement over most toothbrushes and, particularly, Yanz.

Inside the invention are important mechanical innovations. As mentioned, the head behind the bristles is constructed of soft, flex-memory plastic which can be compressed to force the packet within it against puncture means to release the dentifrice. Upon release, the flex-memory plastic returns to its original shape but remains soft and comfortable in the mouth during the brushing process. The head is designed with opposing "J" latches to positively secure the head to the tongue member of the brush body, thus avoiding separation from the brush and a possible choking hazard.

Located within the tongue and beneath the head, is a plurality of innovative hollow syringe-like needles. Unlike related art, notably Matthews and Yanz which disclose solid puncturing spikes to open the dentifrice package, these hollow needles of the present invention operate to first puncture the dentifrice packet and, then, conduct dentifrice to the bristles. Additional, non-puncturing orifices within the tongue aid in conduction and distribution of the dentifrice.

DESCRIPTION OF THE PREFERRED EMBODIMENTS

Figure 1:
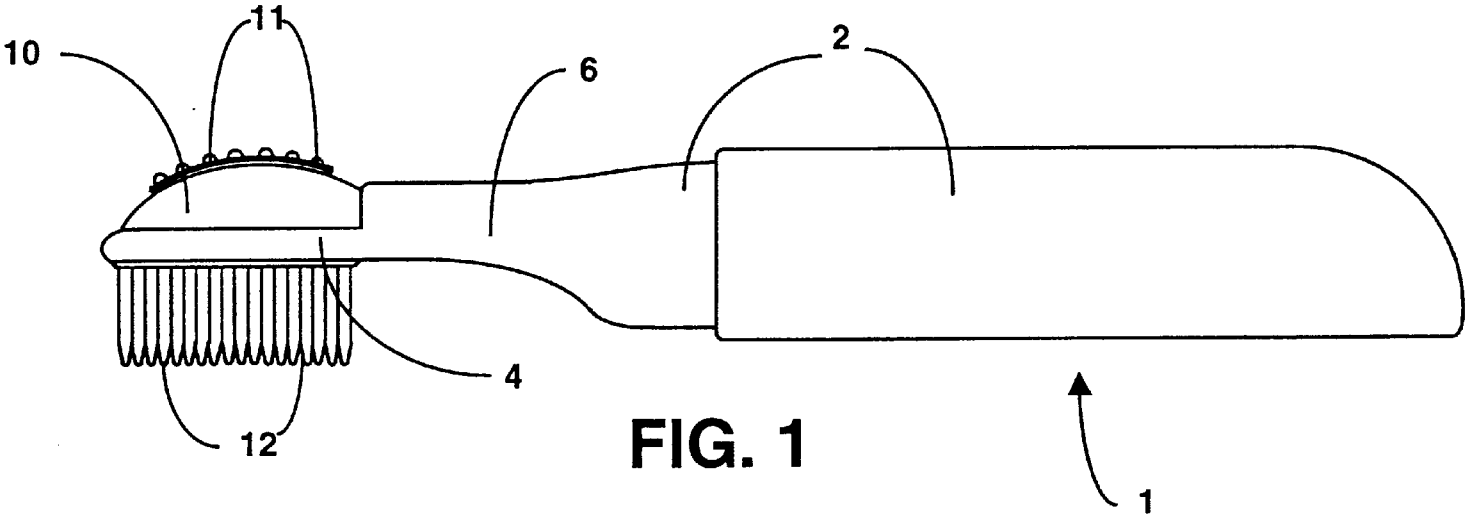
FIG. 1 is a side view of the invention shown without the cap and in ready-to-use configuration.

Referring to FIGS. 1 through 5, there is presented one preferred embodiment of the inventive toothbrush 1, shown without the protective end cap 5 for clarity. The basic elements of the toothbrush are a handle 2, bristles 12, a tongue 4 supporting the bristles, and a neck 6 connecting the tongue 4 to the handle 2. The handle 2 for this portable brush 1 features a recessed area 3 for slidably receiving and securing the protective end cap 5. For clarity and convention, the bristle 12 side of the toothbrush is herein referred to as the "front" of the toothbrush throughout this description and the head 10 side is referred to as the "back".

Figure 2:
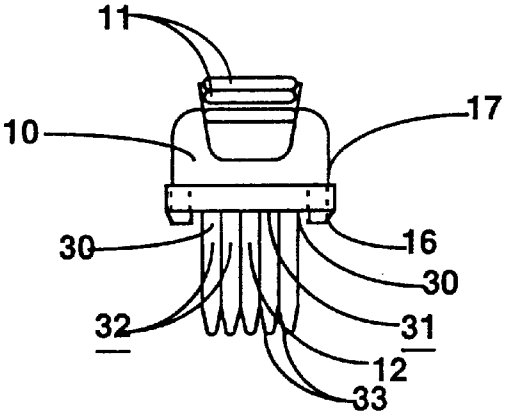
FIG. 2 is an end view of the head and bristle end of the invention shown without the cap.
Figure 3:
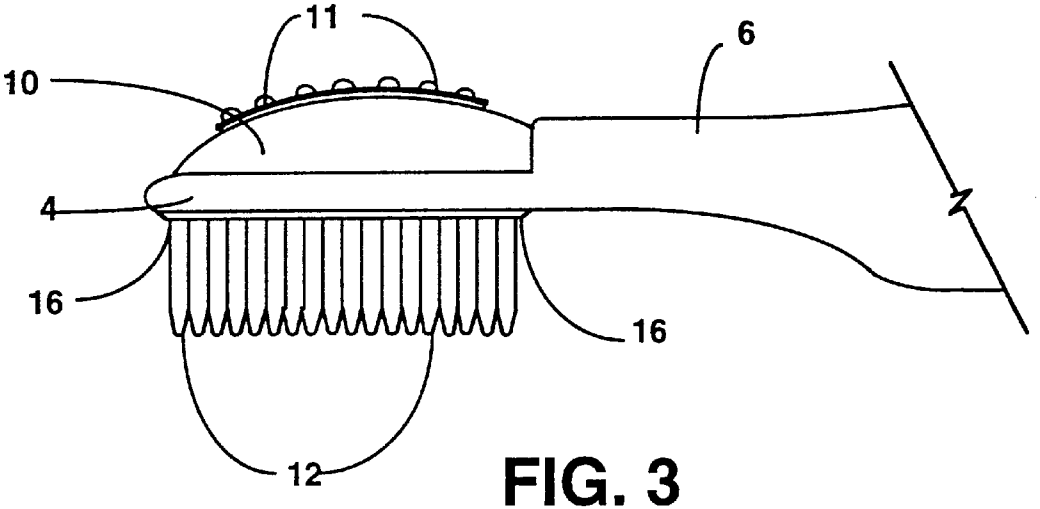
FIG. 3 is an enlarged side view of the head/bristle end of the invention.
Figure 4:
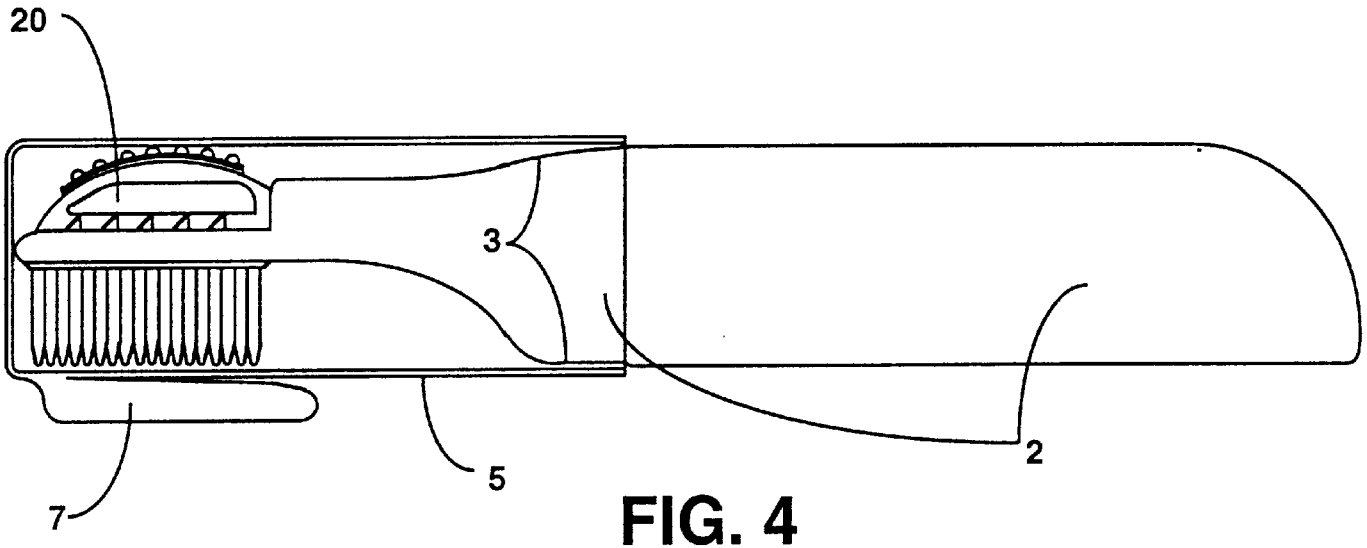
FIG. 4 is a central, longitudinal cross-section of the invention shown with the cap in place.
Figure 7:
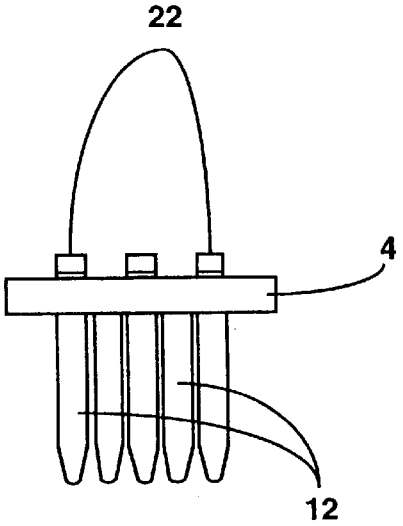
FIG. 7 is an end view of the tongue and bristles.
Figure 8:
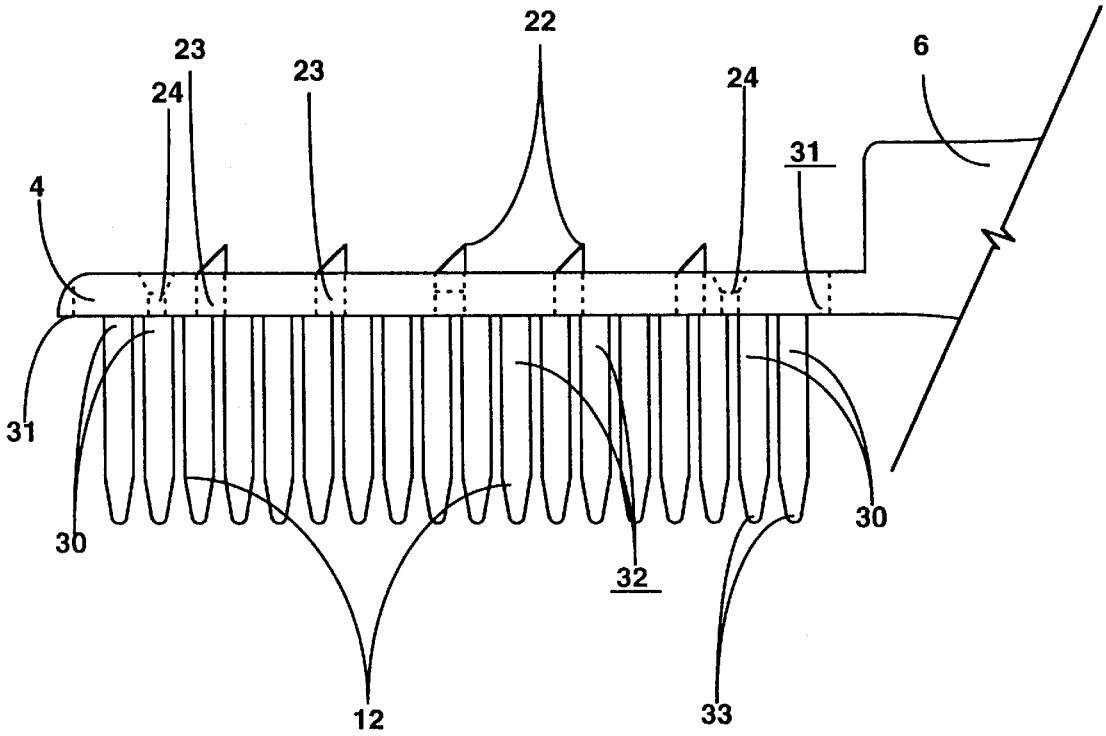
FIG. 8 is a side view of the tongue and bristles.

The flex-memory head 10 attaches to the tongue 4 opposite the bristles 12 by means of twin "J" latch mechanisms 16 molded into the head 10. So configured over the tongue, the flex head forms a flexible compartment cover. Referring now to FIGS. 4 and 6–9, contained in the compartment between the head 10 and the tongue 4 is a package of dentifrice 20 fabricated of plastic or other suitable, puncturable material. Located within tongue 4, and under the head 10 and dentifrice package 20, is a plurality of sharp hollow needles 22 for first puncturing the dentifrice, package 20 and then conducting the dentifrice to the bristles 12. The bristles 12 have bases 30 connected to the tongue 4 near the front surface 31, said bristles 12 having bristle outer surfaces 32, and bristle tips 33. Said bristles 12 extend generally perpendicularly out from the front surface 31 of the tongue 4 so that the tips 33 are a distance from the front surface 31, as shown in FIG. 2 and FIG. 8.

The hollow needles of the preferred embodiment are injection molded into the tongue 4 but could be fabricated by any means and of any material so long as they preserve the integrity of the dentifrice package until pressure is applied and then operate to puncture the dentifrice package and, then, release and conduct the dentifrice through an axial passage 23. "Hollow needle" in the context of this description is intended to include tubes molded within the tongue 4, whether or not such tubes comprise walls independent of the tongue and whether the tube walls upend around holes in the tongue or the tube walls extend through the tongue to also create and define the holes. Thus, "hollow needles" upending from holes in the tongue, or similar language, is intended to include a variety of sharp or pointed designs including integral tubes, separate tubes embedded in the tongue, or separate tubes extending all the way through the tongue. For example, metal barrels, such as the end of a hypodermic needle, might be placed or molded into the tongue. Thus, the hollow needles 22 necessarily include a generally coaxial perimeter or semi-perimeter upending from the back of the tongue around a hole in the tongue for puncturing the dentifrice package upon compression. In the preferred embodiment the coaxial perimeter is some form of cylindrical section, preferably like the end of a hypodermic needle, but in another embodiment the puncturing perimeter component could include any puncturing protuberance upending from or near the perimeter.

Figure 9:
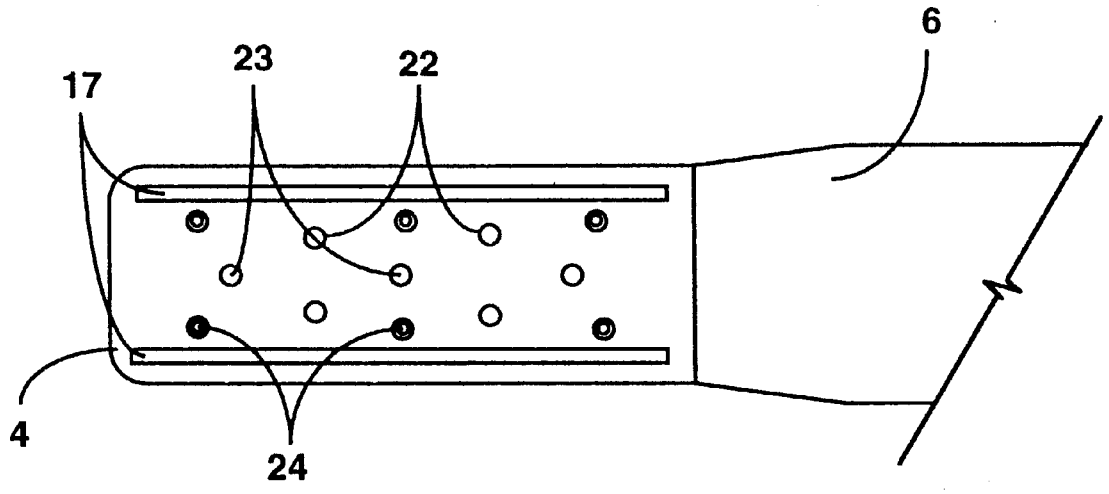
FIG. 9 is a top view of the tongue.

Also within the tongue 4 of the preferred embodiment is a plurality of distribution holes 24 extending entirely through the tongue 4 for better conducting and distributing the dentifrice to the bristles 12, but that do not necessarily include a protuberance above the back surface of the tongue. However, another embodiment of the toothbrush might perform the distribution solely by way of hollow needles 22 and without distribution holes 24, as such, or with solid needles and distribution holes. Details of the preferred tongue 4 are illustrated in FIGS. 7 through 9.

The flex-memory head 10 preferably is rounded, in that it has no sharp angles on its outer surface that would normally contact the user's lips or mouth. Also, the head 10 wall preferably has a generally convex shape when viewed from the top of FIGS. 1–3, in other words, it may be an elongated dome or mound shape.

The flex-memory head 10 is fabricated of flexible plastic and may be compressed, as by thumb pressure, to compress the dentifrice package 20 against the hollow needles 22 and, thus, puncture the package 20. Frictional engagement bumps 11 are included in the back surface of the flex head 10 of the preferred embodiment to facilitate the compression process, particularly in wet conditions. Continued pressure will force the dentifrice through the hollow needles 22 and distribution holes 24 to the bristles 12—and the user's teeth during brushing. Thus, when thumb or finger manual pressure is applied, the flex-memory head 10 (or flex "compartment cover", also #10) compresses concavely inward to engage the dentifrice package 20 and force the package against the hollow needles 22 for puncture. Upon release of pressure, the flex-memory head 10 of the preferred embodiment will spring back to its normal rounded and convex shape, particularly if the dentifrice is to be replaced for reuse. However, another embodiment, particularly a single use toothbrush, would not require the flexible head to return to its uncompressed shape.

The "J" latch mechanisms 16 are, preferably, molded into the head 10 of the same flexible plastic, and extend forward and outward away from the apex end of the head 10, as shown in FIG. 2. Upon being compressed into and passed though the receiving slots 17 which are configured parallel to each longitudinal edge of the tongue 4, the "J" latches are allowed to spring out to their normal position and lock positively against the receiving slots 17 and the bottom of the tongue 4. This positive latch mechanism 16 eliminates the choking hazard presented by potentially loose parts of other toothbrushes and is, in that regard, a significant improvement over related art. The soft, round, and compressible flex-memory head is also a significant improvement over related art. Previously, toothbrushes were invariably hard with rather sharp, uncomfortable edges. Alternative latch mechanisms may be used, particularly if the toothbrush is to be reloaded with a fresh package of dentifrice. The latches may, therefore, be releasable but should be secured through to prevent accidental release while in the user's mouth.

Greater comfort and safety translate to more and better use of the inventive toothbrush. Use is further facilitated by the exterior design of the invention which looks much like a fountain pen. The handle 2 and end cap 5 are configured to be approximately the diameter and length of an enlarged pen, such as some fountain pens, and the end cap 5 of the preferred embodiment has a pen clip 7 molded into it. The cap 5 is self-sealing to accommodate safe, neat, and dry carrying and reuse of the toothbrush. The user is more comfortable carrying the toothbrush to work and environments not usual for toiletries because it looks like a fountain pen. For example, business people will find it easier to carry the invented fountain pen look-alike, and non-leaking, toothbrush in a briefcase or suit-coat pocket. The cap should be close-fitting to ensure that accidental discharge of the paste through the bristles does not result in a spill of the paste from the cap/brush container. Workers, students, and travelers will find the invented, self-contained toothbrush more stylish and discreet than past portable toothbrushes. Thus, the user is more likely to have the toothbrush available and more likely to use it. The combined effect of greater comfort, safety, and availability is more and better use of the inventive toothbrush and significant improvement over related art.

Figure 5:
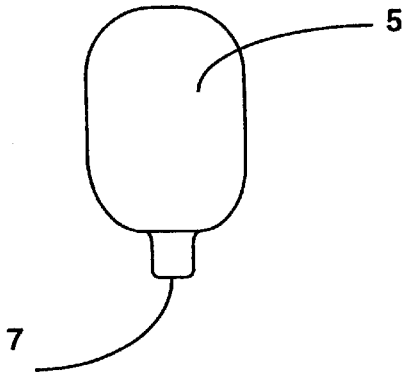
FIG. 5 is an end view of the oblate end cap.
Figure 6:
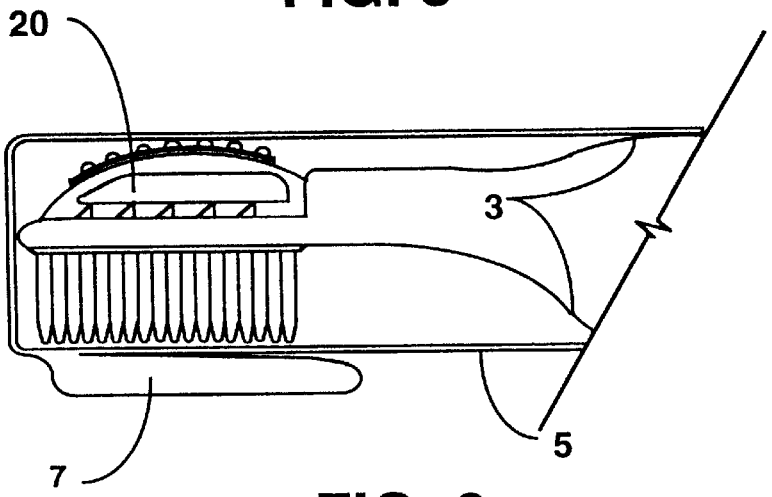
FIG. 6 is a central, longitudinal cross-section of the head/bristle end of the invention with cap.

While the fountain-pen-like appearance is intended to make it a discreet and professional-looking object, the toothbrush also has features which keep the user from confusing it with a pen. Specifically, the handle 2 and cap 5 are shaped to have a generally oblate or non-circular transverse cross-section or end-shape, as illustrated by FIG. 5. Further, the toothbrush preferably is larger in diameter than most pens, which further identifies it to the user.

Although this invention has been described above with reference to particular means, materials and embodiments, it is to be understood that the invention is not limited to these disclosed particulars, but extends instead to all equivalents within the scope of the following claims.

I claim:

1. A toothbrush comprising:

a handle having a longitudinal axis;

a tongue extending longitudinally from the handle and having a front surface and a back surface;

bristles having bases connected to the tongue near the front surface, said bristles having outer surfaces and bristle tips, said bristles extending generally perpendicularly out from the front surface of the tongue, and said tips being a distance from the front surface;

a flexible compartment cover securely affixed to said tongue, said cover enclosing and defining an interior space next to the back surface of the tongue and said cover having a rounded outer surface for increasing comfort in a user's mouth; and a dentifrice package received within the interior space;

wherein the flexible cover is adapted to flex concavely inward to compress the dentifrice package;

wherein the tongue has a plurality of holes extending from the front surface to the back surface, a hole perimeter around each hole, and the tongue having around at least one of the holes a hollow needle upending from the tongue back surface into the interior space and being generally coaxial with the hole perimeter;

wherein the hollow needle is adapted to puncture the dentifrice package when the flexible cover is depressed to compress the package against the hollow needle, and wherein the holes are adapted to conduct dentifrice from the punctured dentifrice package to the front surface of the tongue and to the outer surface of the bristles.

2. A toothbrush as in claim 1 further comprising a plurality of opposed J-shaped latches extending forward and outward from the flexible compartment cover, and the tongue having corresponding receiving slots receiving said J-shaped latches to secure the cover to the tongue around the package.

3. A toothbrush comprising:

a handle having a longitudinal axis;

a tongue extending longitudinally from the handle and having a front surface and a back surface;

bristles extending generally perpendicularly out from the front surface of the tongue, said bristles having base outer surfaces near the tongue front surface and said bristles having bristle tips distanced from the front surface;

a compartment cover affixed to said tongue, said cover enclosing and defining an interior space next to the back surface of the tongue;

a dentifrice package received within the interior space;

a plurality of hollow needles extending upward from the back surface of the tongue into the interior space, each hollow needle having an axial passage adapted to conduct fluid from the interior space through the tongue to the bristles; and a plurality of distribution holes through the tongue from the back surface to the front surface adapted to deliver dentifrice from the interior surface to the front surface and to the base outer surfaces, said distribution holes having no protuberances from the back surface of the tongue;

wherein the cover is adapted to be moveable to compress the dentifrice package against the hollow needles for puncture of the dentifrice package and transport of the dentifrice to and through the axial passages of the hollow needles and the distribution holes.

4. A portable toothbrush as in claim 3 comprising a J-shaped latch extending forward and outward from apex end of the flexible compartment cover for closing the compartment cover.

* * * * *